US012117173B1

(12) United States Patent
Gauvreau et al.

(10) Patent No.: US 12,117,173 B1
(45) Date of Patent: Oct. 15, 2024

(54) INTERNAL COMBUSTION ENGINE WITH CERAMIC PILOT CHAMBER COMPONENT(S)

(71) Applicant: Pratt & Whitney Canada Corp., Longueuil (CA)

(72) Inventors: Jean-Gabriel Gauvreau, Varennes (CA); Johnny Vinski, Chateauguay (CA)

(73) Assignee: Pratt & Whitney Canada Corp., Longueuil (CA)

( * ) Notice: Subject to any disclaimer, the term of this patent is extended or adjusted under 35 U.S.C. 154(b) by 0 days.

(21) Appl. No.: 18/135,575

(22) Filed: Apr. 17, 2023

(51) Int. Cl.
*F23Q 9/00* (2006.01)

(52) U.S. Cl.
CPC ..... *F23Q 9/00* (2013.01)

(58) Field of Classification Search
CPC ..... F01C 21/183; F01C 1/22; F01C 21/106; F01C 21/18; F01C 21/06; F01C 20/06; F01C 20/10; F01C 21/08; F01C 20/24; F01C 11/006; F02B 53/02; F02B 53/10; F02B 19/12; F02B 55/08; F02B 53/12; F02B 19/10; F04C 2240/80; F04C 29/0092; Y02T 10/12
USPC ..... 123/210
See application file for complete search history.

(56) References Cited

U.S. PATENT DOCUMENTS 3,911,874 A 10/1975 Vincent
5,715,787 A 2/1998 Kawamura
5,915,351 A 6/1999 Regueiro
9,528,434 B1 12/2016 Thomassin
10,041,402 B2 8/2018 Schulz
2015/0337726 A1* 11/2015 Gekht ..... F01C 21/06 418/83
2019/0055882 A1* 2/2019 Thomassin ..... F01C 21/183

FOREIGN PATENT DOCUMENTS

AT 413855 B 6/2006
EP 2205840 B1 2/2012
JP 61093227 A 5/1986

OTHER PUBLICATIONS

EP Search Report for EP Patent Application No. 24170893.2 dated Aug. 29, 2024.

* cited by examiner

*Primary Examiner* — Shafiq Mian
(74) *Attorney, Agent, or Firm* — Getz Balich LLC

(57) ABSTRACT

An assembly is provided for a powerplant. This assembly includes a housing, a primary fuel injector and an ignition system. The housing forms a combustion volume within the housing. The primary fuel injector is configured to inject primary fuel into the combustion volume. The ignition system is configured to ignite the primary fuel within the combustion volume. The ignition system includes a pilot fuel injector, a pilot ignitor, a pilot chamber, a first component and a second component. The pilot fuel injector is configured to inject pilot fuel into the pilot chamber. The pilot ignitor is configured to ignite the pilot fuel within the pilot chamber. The pilot chamber is fluidly coupled with the combustion volume through an aperture in the first component. The pilot chamber is formed by and disposed between the first component and the second component. The first component is configured from or otherwise include a ceramic.

18 Claims, 8 Drawing Sheets

INTERNAL COMBUSTION ENGINE WITH CERAMIC PILOT CHAMBER COMPONENT(S)

TECHNICAL FIELD

This disclosure relates generally to an internal combustion engine and, more particularly, to an ignition system for the engine.

BACKGROUND INFORMATION

An internal combustion engine includes an ignition system for igniting a fuel-air mixture for combustion. Various types and configurations of ignition systems are known in the art. While these known ignition systems have various benefits, there is still room in the art for improvement.

SUMMARY

According to an aspect of the present disclosure, an assembly is provided for a powerplant. This assembly includes a housing, a primary fuel injector and an ignition system. The housing forms a combustion volume within the housing. The primary fuel injector is configured to inject primary fuel into the combustion volume. The ignition system is configured to ignite the primary fuel within the combustion volume. The ignition system includes a pilot fuel injector, a pilot ignitor, a pilot chamber, a first component and a second component. The pilot fuel injector is configured to inject pilot fuel into the pilot chamber. The pilot ignitor is configured to ignite the pilot fuel within the pilot chamber. The pilot chamber is fluidly coupled with the combustion volume through an aperture in the first component. The pilot chamber is formed by and disposed between the first component and the second component. The first component is configured from or otherwise include a ceramic.

According to another aspect of the present disclosure, another assembly is provided for a powerplant. This assembly includes a housing, a first component, a second component, a fuel injector and an ignitor. The housing forms a combustion volume within the housing. The first component includes a cavity, a receptacle and an aperture. The cavity forms at least a portion of a chamber within the first component. The receptacle extends longitudinally into the first component to the cavity. The aperture fluidly couples the chamber to the combustion volume. The first component is configured from or otherwise includes a ceramic. The second component projects longitudinally into the receptacle to the chamber. The fuel injector is configured to inject fuel into the chamber. The ignitor is configured to ignite the fuel within the chamber.

According to still another aspect of the present disclosure, another assembly is provided for a powerplant. This assembly includes a housing, a chamber module, a fuel injector and an ignitor. The housing forms a combustion volume within the housing. The chamber module is fastened to the housing. The chamber module includes a first component, a second component, a support ring and a chamber. The first component is clamped between the second component and the support ring. The first component projects through a receptacle in the housing to the combustion volume. The second component is secured to the support ring through a threaded interface between the second component and the support ring. The chamber is formed by and between the first component and the second component. The chamber is fluidly coupled to the combustion volume through an aperture in the first component. The fuel injector is configured to inject fuel into the chamber. The ignitor is configured to ignite the fuel within the chamber.

The second component may be configured from or otherwise include a metal.

The pilot chamber may have a spherical geometry.

A majority of a volume of the pilot chamber may be formed within the first component.

The first component may extend longitudinally along a centerline towards the combustion volume. A portion of the pilot chamber may extend laterally into and longitudinally within a sidewall of the first component.

The first component may include a cavity and a receptacle. The cavity may form at least a portion of the pilot chamber within the first component. The receptacle may extend longitudinally into the first component to the cavity. The second component may project longitudinally into the receptacle to the pilot chamber.

The second component may include a recess at a distal end of the second component. The recess may form a portion of the pilot chamber within the second component.

The cavity may have a lateral cavity width. The receptacle may have a lateral receptacle width at a longitudinal interface between the receptacle and the cavity. The lateral receptacle width may be smaller than the lateral cavity width.

A second receptacle may extend longitudinally into the housing from an exterior of the housing to the combustion volume. The first component may be disposed within the second receptacle and project longitudinally to the combustion volume.

The assembly may also include a cover secured to the housing and enclosing the first component and the second component within the second receptacle.

The second component may be fastened to the housing by one or more fasteners. The first component may be clamped between the second component and the housing.

The assembly may also include a first seal element and/or a second seal element. The first seal element may be engaged with and between the first component and the housing. The second seal element may be engaged with and between the first component and the second component.

The assembly may also include a pilot chamber module. The pilot chamber module may include the first component, the second component and a support ring. The second component may be fastened to the support ring. The first component may be clamped between the second component and the support ring.

The second component may be threaded into the support ring.

The assembly may also include a first seal element and/or a second seal element. The first seal element may be engaged with and between the support ring and the housing. The second seal element may be engaged with and between the second component and the support ring.

The assembly includes a cover over the pilot chamber module. The cover is fastened to the housing by one or more fasteners. The pilot chamber module is clamped between the cover and the housing.

The pilot fuel injector may be configured to inject the pilot fuel into the pilot chamber through a fuel aperture in the first component. In addition or alternatively, the pilot ignitor may be received in an ignitor aperture in the first component.

The assembly may also include a rotary engine that includes the housing, the primary fuel injector and the ignition system.

The present disclosure may include any one or more of the individual features disclosed above and/or below alone or in any combination thereof.

The foregoing features and the operation of the invention will become more apparent in light of the following description and the accompanying drawings.

DETAILED DESCRIPTION

Figure 1:
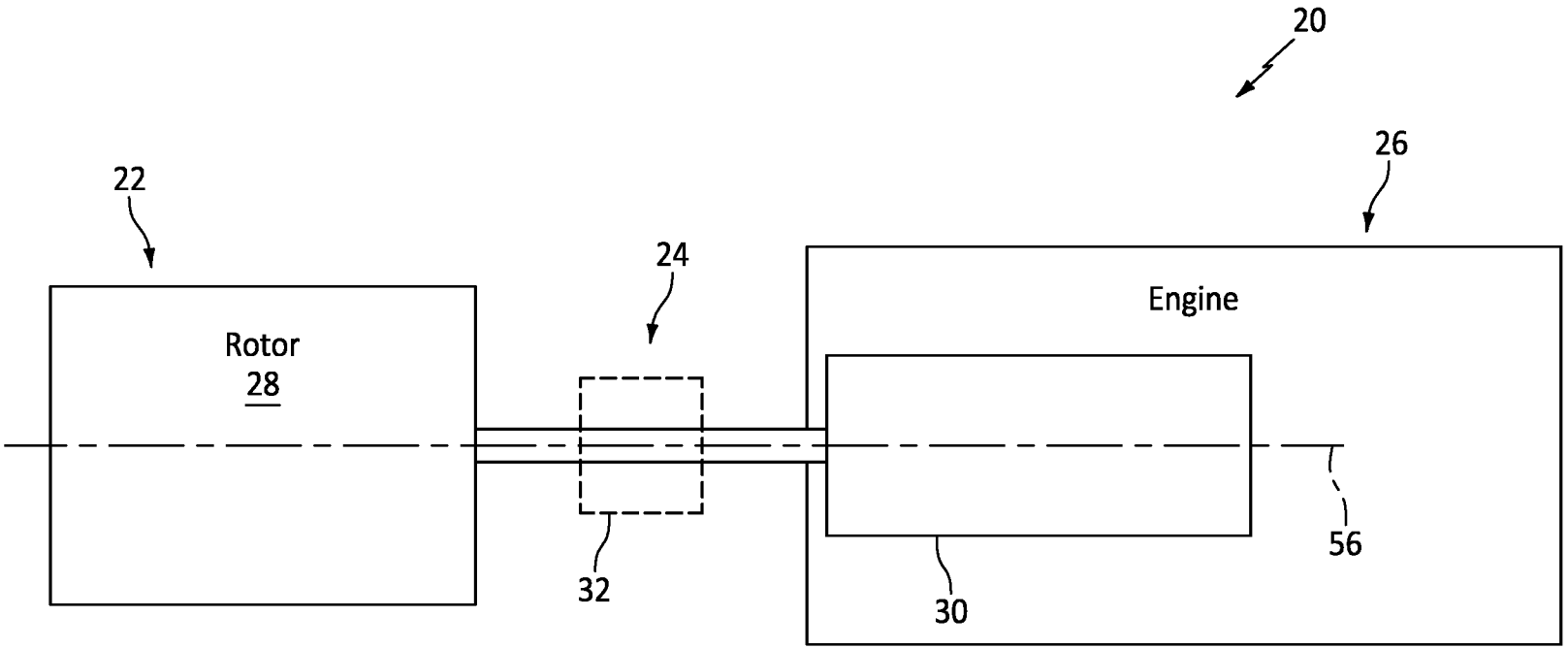
FIG. 1 is a schematic illustration of a powerplant.

FIG. 1 illustrates a powerplant 20 for an aircraft. This aircraft may be configured as an airplane, a rotorcraft, a drone (e.g., an unmanned aerial vehicle (UAV)) or any other manned or unmanned aerial vehicle. The powerplant 20 of FIG. 1 includes a mechanical load 22, a drivetrain 24 and an internal combustion (IC) engine 26, where the drivetrain 24 mechanically couples the mechanical load 22 to the engine 26.

The mechanical load 22 may be configured as or otherwise include a rotor 28 mechanically driven by the engine 26 through the drivetrain 24. This driven rotor 28 may be a bladed propulsor rotor where the powerplant 20 is configured as or otherwise includes a propulsion system for the aircraft. The propulsor rotor may be an open (e.g., unducted) rotor for the aircraft such as, but not limited to, a propeller rotor or a rotorcraft rotor (e.g., a main helicopter rotor). Alternatively, the propulsor rotor may be a ducted rotor for the aircraft such as, but not limited to, a fan rotor. Still alternatively, the driven rotor 28 may be a generator rotor in an electrical power generator where the powerplant 20 is configured as or otherwise includes an auxiliary power unit (APU) for the aircraft. The present disclosure, however, is not limited to the foregoing exemplary driven rotor configurations. Furthermore, the present disclosure is not limited to aircraft applications. The powerplant 20, for example, may alternatively be configured as a ground-based electrical generator or a powerplant for a ground vehicle.

The drivetrain 24 may be configured as a direct-drive drivetrain. With such a configuration, the driven rotor 28 is operable to rotate at a common (the same) rotational speed as a rotating structure 30 of the engine 26. Alternatively, the drivetrain 24 may be configured as a geared drivetrain. With such a configuration, the drive rotor is operable to rotate as a different (e.g., fastener or slower) rotational speed than the rotating structure 30. The drivetrain 24, for example, may include a geartrain 32 and/or another transmission device coupled between the driven rotor 28 and the rotating structure 30.

The engine 26 may be configured as a rotary engine such as, but not limited to, a Wankel engine. The engine 26 of FIG. 2, for example, includes an engine housing 34, an engine rotor 36, a primary fuel injector 38 and an ignition system 40.

Figure 2:
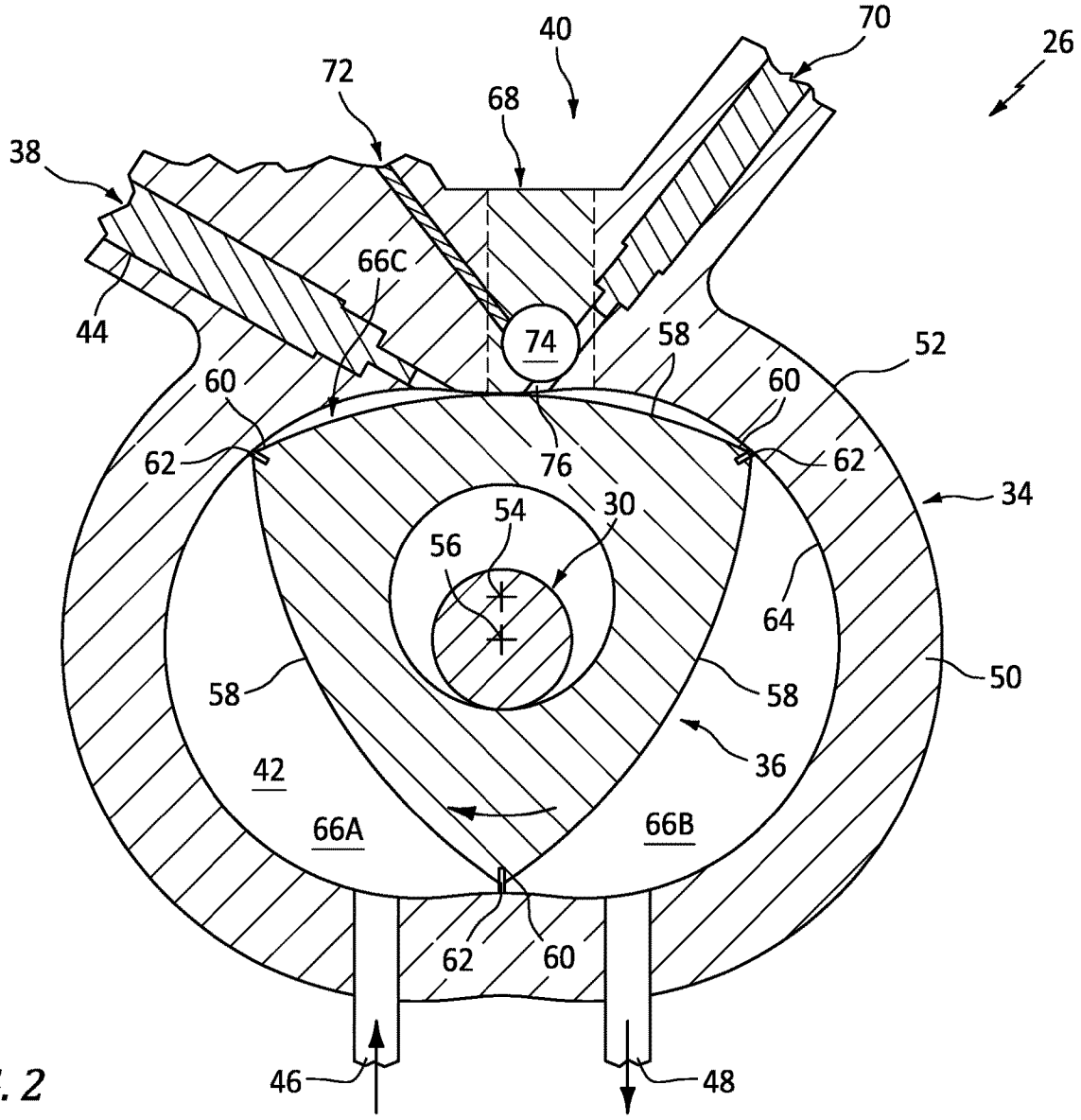
FIG. 2 is a sectional schematic illustration of an internal combustion engine.

The housing 34 of FIG. 2 includes an internal housing cavity 42, a primary fuel injector receptacle 44, an intake passage 46 and an exhaust passage 48. The housing 34 is also configured for mating with the ignition system 40 as described below in further detail. The housing cavity 42 is formed within and enclosed by the housing 34. The primary fuel injector receptacle 44 extends through a sidewall 50 of the housing 34 from an exterior 52 of the housing 34 to the housing cavity 42. The intake passage 46 extends from an inlet into the engine 26, through the housing sidewall 50, to the housing cavity 42, which engine inlet may also be an inlet to the powerplant 20 (see FIG. 1). The exhaust passage 48 extend from the housing cavity 42, through the housing sidewall 50, to an exhaust from the engine 26, which engine exhaust may also be an exhaust from the powerplant 20 (see FIG. 1).

The rotor 36 of FIG. 2 is disposed within the housing cavity 42, where the housing sidewall 50 extends circumferentially around an outer periphery of the rotor 36. The rotor 36 is coupled to and rotatable with the rotating structure 30. However, the rotor 36 of FIG. 2 is eccentric to the rotating structure 30. A centerline 54 of the rotor 36, for example, is parallel with, but offset from, a centerline 56 of the rotating structure 30, where the rotor centerline 54 is also a rotational axis of the rotor 36 and/or where the rotating structure centerline 56 is also a rotational axis of the rotating structure 30. With this arrangement, as the rotor 36 rotates about its rotor centerline 54, the rotor centerline 54 moves (e.g., circles) about the rotating structure centerline 56.

The rotor 36 may have a non-circular, lobed cross-sectional geometry when viewed, for example, in a reference plane perpendicular to the rotor centerline 54. The rotor 36 of FIG. 2, for example, includes a plurality of (e.g., arcuate, convex) peripheral rotor faces 58 arranged circumferentially about the rotor centerline 54. Each circumferentially neighboring (e.g., adjacent) pair of the rotor faces 58 meets at a respective apex 60 of the rotor 36. The rotor 36 may also include one or more rotor seals 62, where each rotor seal 62 is arranged at (e.g., on, adjacent or proximate) a respective one of the rotor apexes 60. Each rotor seal 62 is configured to sealingly engage (e.g., contact) and thereby form a seal interface with an interior 64 of the housing sidewall 50.

The rotor 36 and the housing 34 may collectively form one or more combustion volumes 66A-C(generally referred to as "66") (e.g., combustion chambers, working volumes, etc.) within the housing 34. Each combustion volume 66, in particular, is formed by and between a respective one of the rotor faces 58 and a corresponding (albeit changing) portion of the housing sidewall 50, and circumferentially between a respective neighboring pair of the rotor seals 62. Each of the combustion volumes 66 moves about the centerline 54, 56 as the rotor 36 eccentrically rotates within the housing 34 and its housing cavity 42. With the rotor position of FIG. 2, the combustion volume 66A is fluidly coupled with the intake passage 46 (and fluidly decoupled from the exhaust passage 48), the combustion volume 66B is fluidly coupled with the exhaust passage 48 (and fluidly decoupled from the intake passage 46), and the combustion volume 66C is fluidly decoupled from the intake passage 46 and the exhaust passage 48.

The primary fuel injector 38 is mated with/received within the primary fuel injector receptacle 44. The primary fuel injector 38, for example, projects into the primary fuel injector receptacle 44 and is threaded into or otherwise attached to the housing 34.

The ignition system 40 is attached to the housing 34 as described below in further detail.

During engine operation, air is directed through the intake passage 46 into a respective one of the combustion volumes 66. As the rotor 36 rotates within the housing 34, a volumetric measure of the respective combustion volume 66 decreases thereby compressing the air within that combustion volume 66. The primary fuel injector 38 directs (e.g., injects) primary fuel into the respective combustion volume 66 to mix with the air as it is being compressed to provide a fuel-air mixture. When the respective combustion volume 66 aligns with the ignition system 40, the fuel-air mixture within that combustion volume 66 is ignited to generate combustion products. As the rotor 36 continues to rotate within the housing 34, the volumetric measure of the respective combustion volume 66 increases thereby facilitating expansion of the combustion products within the respective combustion volume 66 until those expanded combustion products are exhausted from the engine 26 through the exhaust passage 48. The expansion of the combustion products within the respective combustion volume 66 drives rotation of the rotor 36 within the housing 34. The rotation of the rotor 36 and, thus, the rotation of the rotating structure 30 in turn drives rotation of the driven rotor 28 of FIG. 1 through the drivetrain 24.

Referring to FIG. 2, to ignite the fuel-air mixture within one of the combustion volumes 66, the ignition system 40 is configured to introduce a flame (e.g., a pilot flame) and/or relatively hot combustion products into the respective combustion volume 66. The ignition system 40 of FIG. 2, for example, includes a pilot chamber structure 68 ("pilot structure") (schematically shown), a pilot fuel injector 70 ("pilot injector") and a pilot ignitor 72 (e.g., a spark plug, a glow plug, etc.). The pilot structure 68 includes an internal pilot chamber 74 (e.g., a sub-chamber, a pre-ignition chamber, etc.) and a pilot aperture 76 (e.g., a transfer hole) which fluidly couples the pilot chamber 74 to the respective combustion volume 66. The pilot injector 70 is configured to direct (e.g., inject) pilot fuel into the pilot chamber 74. The pilot ignitor 72 is configured to ignite the pilot fuel within the pilot chamber 74 to generate the pilot flame and/or the pilot combustion products. The pilot flame and/or the pilot combustion products are directed through the pilot aperture 76 into the respective combustion volume 66 to ignite the fuel-air mixture within that combustion volume 66.

The combustion of the pilot fuel within the pilot chamber 74 may be continuous (e.g., sustained) throughout an engine cycle. Here, the term "engine cycle" may describe a cycle as the rotor 36 makes a complete rotation about the rotor centerline 54 within the housing 34. The continuous combustion within the pilot chamber 74 may subject the pilot structure 68 to relatively high thermal loads, particularly a portion of the pilot chamber 74 adjacent and partially forming the respective combustion volume 66. Such high thermal loads may cause relatively high compressive stresses within the pilot structure 68 which may affect pilot structure durability. Moreover, the high thermal loads paired with a relatively high velocity fluid flow associated with directing the flame and/or the combustion products through the pilot aperture 76 into the respective combustion volume 66 may erode material of the pilot structure 68 forming the pilot aperture 76.

To increase pilot structure durability, the pilot structure 68 may be manufactured from ceramic such as, but not limited to, SiN or SiC ceramic material. However, casting or sintering a single monolithic ceramic body with an embedded chamber may be difficult. Furthermore, even where a single monolithic ceramic body with an embedded chamber can be formed, it may be difficult to finish surface(s) forming the embedded chamber due to minimal (if any) tool access into the chamber. Therefore, referring to FIG. 3, the pilot structure 68 may be formed as a multi-component structure. The pilot structure 68 of FIG. 3, for example, includes a first component 78 (e.g., an inner and/or base structure) and a second component 80 (e.g., an outer and/or plug structure).

Figure 4:
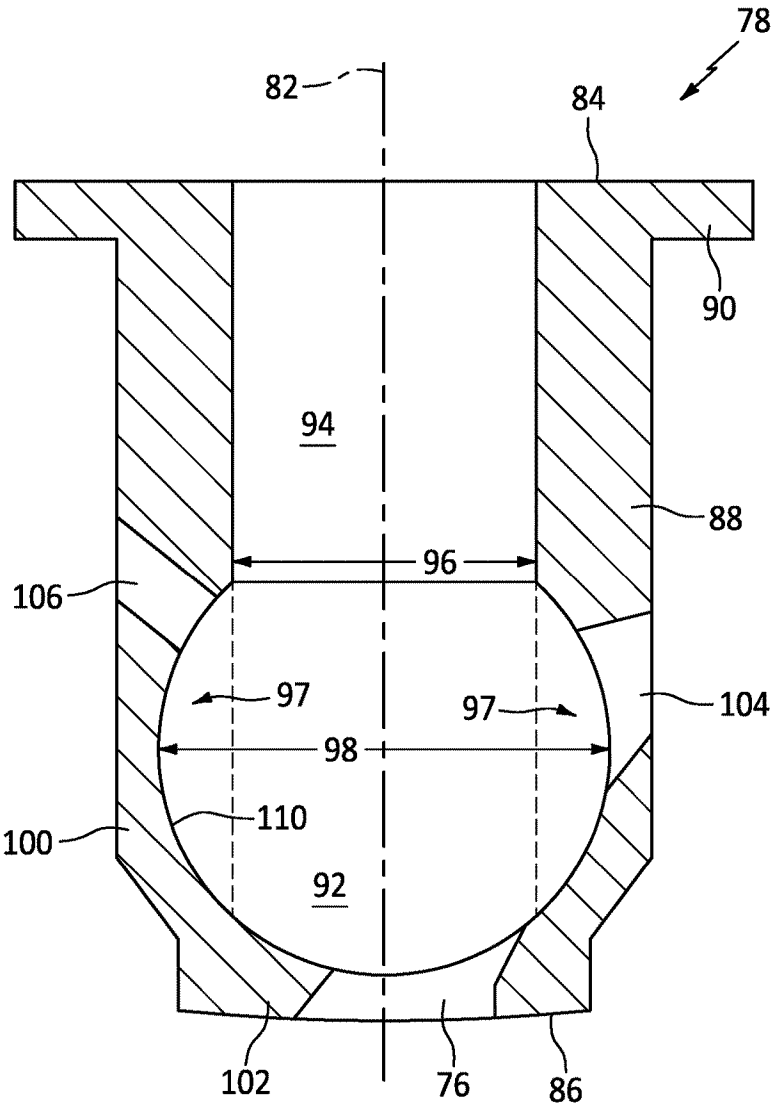
FIG. 4 is a sectional illustration of a first component of the ignition system.

Referring to FIG. 4, the first component 78 extends longitudinally along a longitudinal centerline 82 between and to an outer end 84 of the first component 78 and a distal inner end 86 of the first component 78. This longitudinal centerline 82 may be a centerline of the pilot structure 68 and/or one or more of its components 78 and/or 80 (see also FIG. 6). The first component 78 of FIG. 4 includes a first component base 88 ("first base") and a first component mount 90 ("first mount") connected to (e.g., formed integral with) the first base 88.

The first base 88 projects longitudinally along the longitudinal centerline 82 from the first component outer end 84 to the first component inner end 86. The first base 88 includes an internal chamber cavity 92, a second component receptacle 94 and the pilot aperture 76.

The chamber cavity 92 is disposed (e.g., completely) within the first base 88 proximate the first component inner end 86, and longitudinally between the second component receptacle 94 and the pilot aperture 76. The second component receptacle 94 projects longitudinally along the longitudinal centerline 82 into the first base 88 from the first component outer end 84 to the chamber cavity 92. The second component receptacle 94 may be cylindrical with a uniform (e.g., constant) lateral receptacle width 96 (e.g., diameter) along its longitudinal length. A lateral cavity width 98 of the chamber cavity 92, on the other hand, may change along its longitudinal length. The lateral cavity width 98 may have a (e.g., maximum) value that is larger than a value of the lateral receptacle width 96 at a longitudinal interface between the chamber cavity 92 and the second component receptacle 94. With this arrangement, a (e.g., annular) portion 97 of the chamber cavity 92 extends partially laterally (e.g., radially) into and longitudinally within a sidewall 100 of the first component 78 and its first base 88. A portion of the first base 88 and its first sidewall 100 at the interface may thereby partially laterally overhang the chamber cavity 92.

The pilot aperture 76 extends through an endwall 102 of the first component 78 and its first base 88 from the chamber cavity 92 to the first component inner end 86. A centerline of the pilot aperture 76 may be angularly offset from the longitudinal centerline 82 by a non-zero acute angle. The present disclosure, however, is not limited to such an exemplary angularly offset pilot aperture arrangement.

The first base 88 may also include a fuel aperture 104 and at least one ignitor aperture 106. Each of these apertures 104, 106 extends through the first sidewall 100 to the chamber cavity 92. The fuel aperture 104 and the ignitor aperture 106 may be disposed on opposing lateral sides of the chamber cavity 92.

Figure 5:
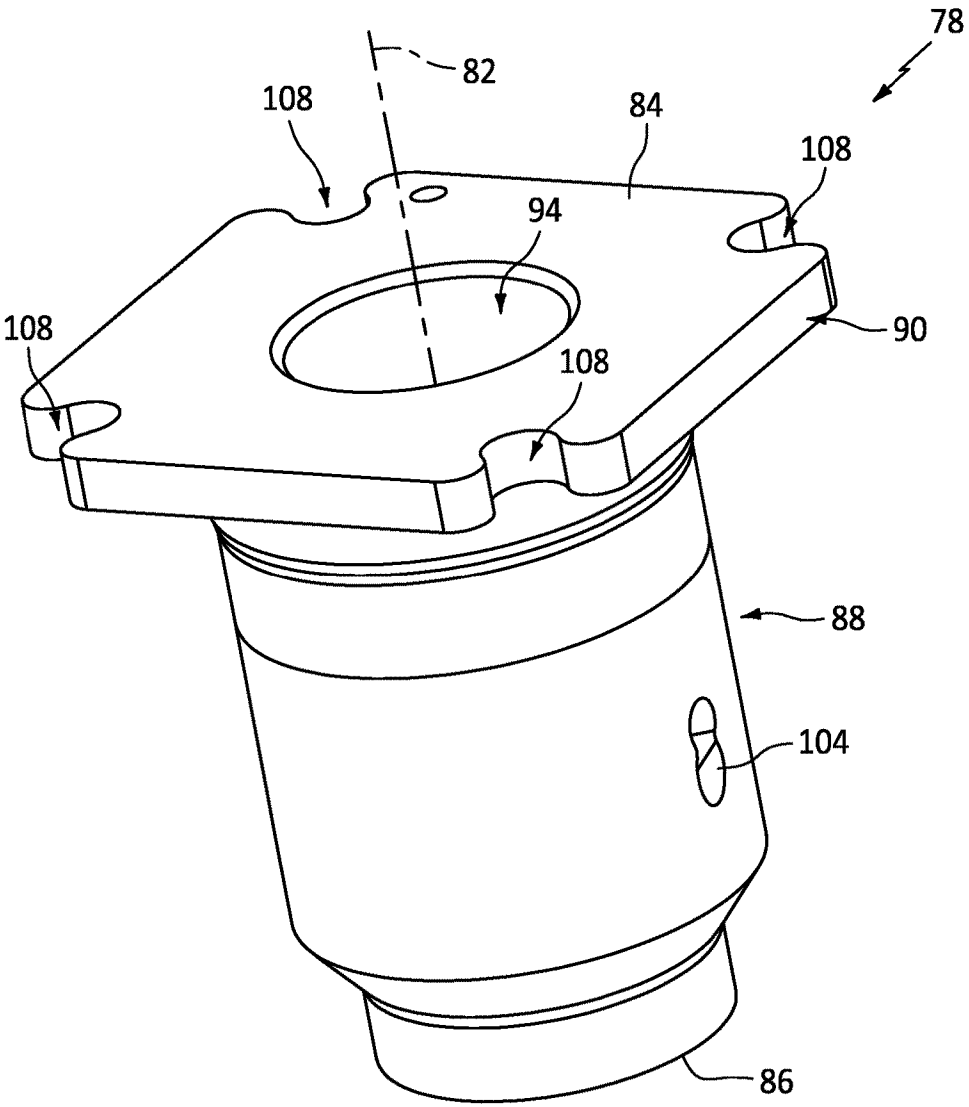
FIG. 5 is a perspective illustration of the first component.

The first mount 90 is disposed at the first component outer end 84. The first mount 90 extends circumferentially about (e.g., completely around) the first base 88. The first mount 90 projects laterally out from the first base 88 to a lateral outer periphery of the first mount 90. Referring to FIG. 5, this lateral outer periphery of the first mount 90 may have a substantially polygonal (e.g., square) shape when viewed, for example, in a reference plane perpendicular to the longitudinal centerline 82. The first mount 90 may include one or more first fastener apertures 108; e.g., slots. Each first fastener aperture 108 is disposed at a respective corner of the first mount 90. Each first fastener aperture 108 of FIG. 5 projects laterally into and longitudinally through the first mount 90. It is contemplated, however, one or more of the first fastener apertures 108 may each alternatively be configured as a through hole.

Referring to FIG. 4, the first component 78 may be formed from the ceramic material. The first component 78, for example, may be cast, sintered and/or otherwise formed as a monolithic body of the ceramic. Since the chamber cavity 92 is open by way of the second component receptacle 94 to an exterior of the first component 78, one or more tools may be inserted into the chamber cavity 92 through the second component receptacle 94 to provide a surface 110 forming the chamber cavity 92 with a prescribed surface finish. The cavity surface 110, in order words, may be subject to one or more finishing operations such as grinding, sanding, polishing, coating, etc.

Figure 6:
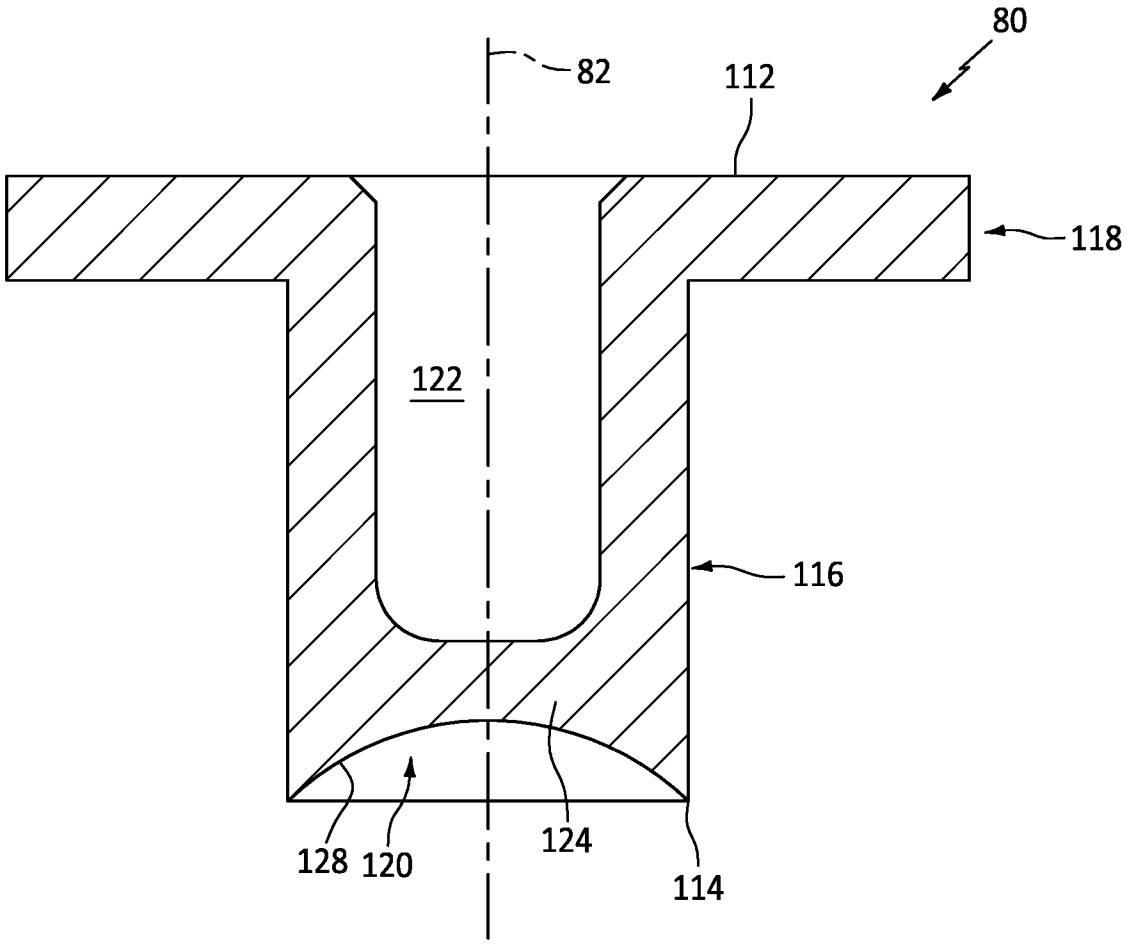
FIG. 6 is a sectional illustration of a second component of the ignition system.

Referring to FIG. 6, the second component 80 extends longitudinally along the longitudinal centerline 82 between and to an outer end 112 of the second component 80 and an inner end 114 of the second component 80. The second component 80 of FIG. 6 includes a second component base 116 ("second base") and a second component mount 118 ("second mount") connected to (e.g., formed integral with) the second base 116.

The second base 116 projects longitudinally along the longitudinal centerline 82 from the second component outer end 112 to the second component inner end 114. The second base 116 includes a chamber recess 120 at the second component inner end 114. This chamber recess 120 extends partially longitudinally into the second base 116 from the second component inner end 114. The second base 116 may also include a (e.g., weight-reduction) bore 122 at the first component inner end 86. This bore 122 extends partially longitudinally into the second base 116 from the second component outer end 112, where an endwall 124 of the second base 116 may completely separate the bore 122 from the chamber recess 120.

Figure 7:
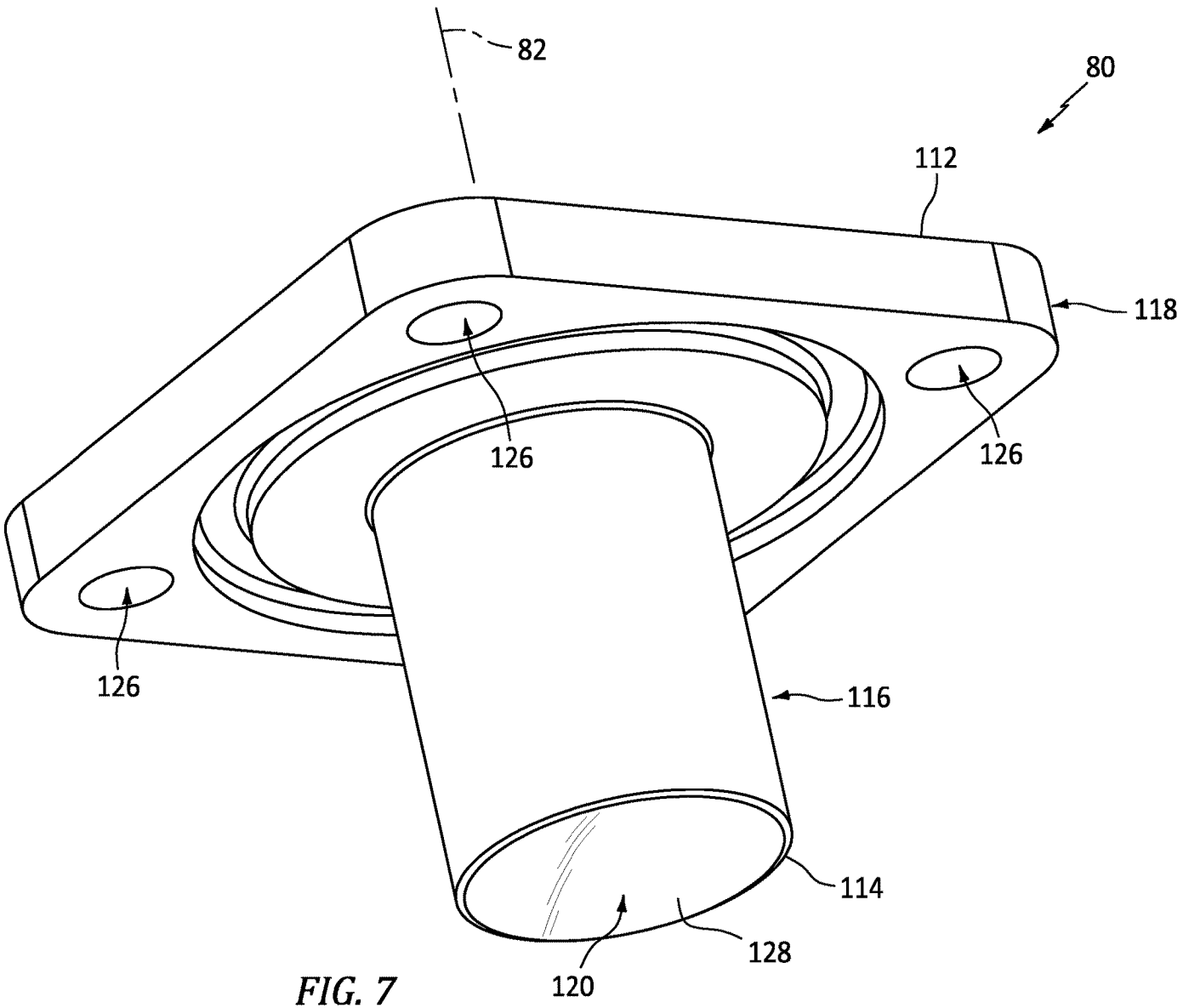
FIG. 7 is a perspective illustration of the second component.

The second mount 118 is disposed at the second component outer end 112. The second mount 118 extends circumferentially about (e.g., completely around) the second base 116. The second mount 118 projects laterally out from the second base 116 to a lateral outer periphery of the second mount 118. Referring to FIG. 7, this lateral outer periphery of the second mount 118 may have a substantially polygonal (e.g., square) shape when viewed, for example, in a reference plane perpendicular to the longitudinal centerline 82. The second mount 118 may include one or more second fastener apertures 126; e.g., through-holes. Each second fastener aperture 126 is disposed at a respective corner of the second mount 118. Each second fastener aperture 126 of FIG. 7 projects longitudinally through the second mount 118. It is contemplated, however, one or more of the second fastener apertures 126 may each alternatively be configured as a slot.

Referring to FIG. 6, the second component 80 may be formed from metal or ceramic, which ceramic may be the same as or different than the ceramic material forming the first component 78. The second component 80, for example, may be cast, sintered and/or otherwise formed as a monolithic body of the metal or the ceramic material. Since the chamber recess 120 is open at the second component inner end 114, one or more tools may be inserted into the chamber recess 120 to provide a surface 128 forming the chamber recess 120 with a prescribed surface finish. The recess surface 128, in order words, may be subject to one or more finishing operations such as grinding, sanding, polishing, coating, etc.

Figure 3:
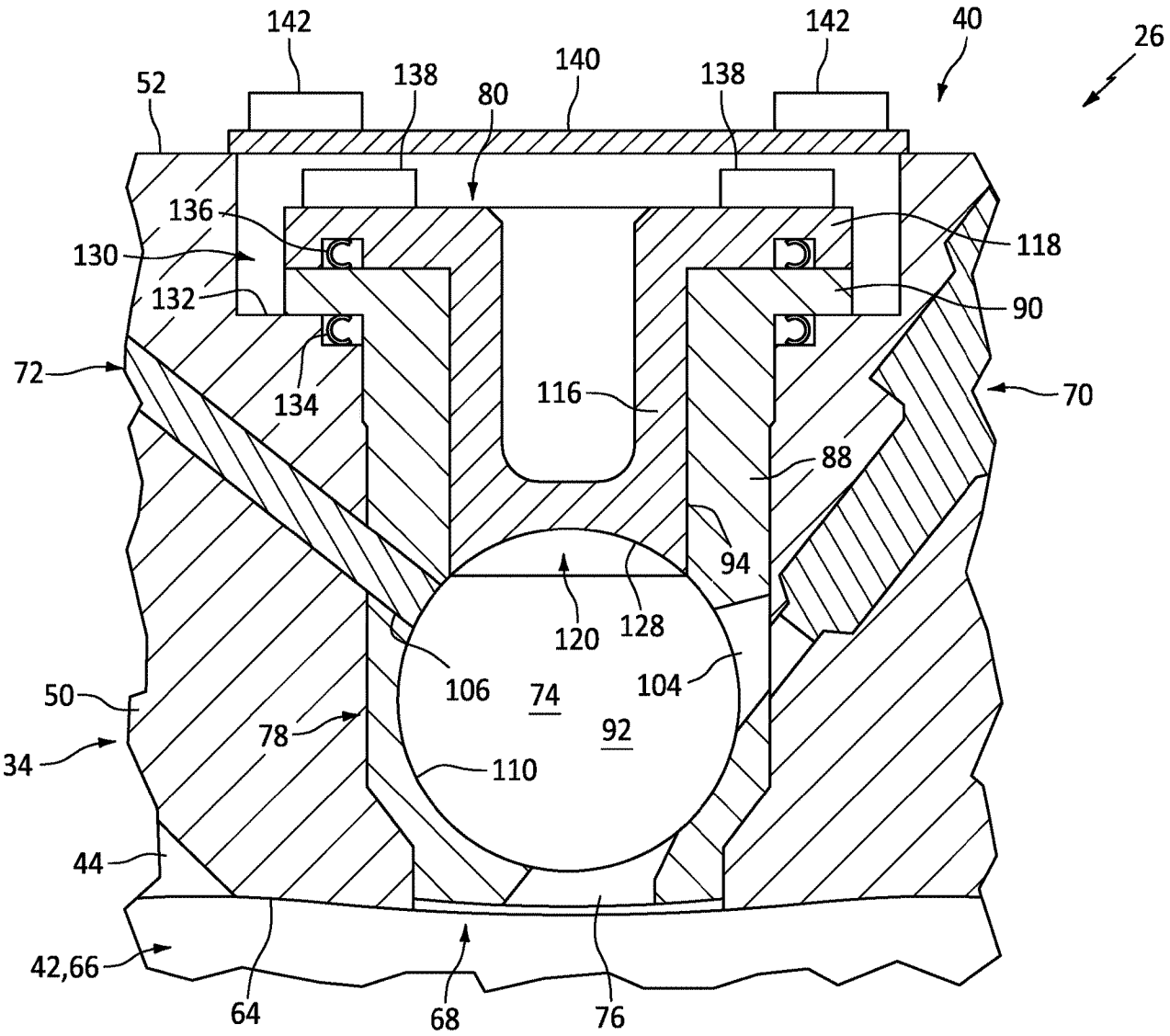
FIG. 3 is a sectional illustration of a portion of the engine with an ignition system.

Referring to FIG. 3, the first component 78 is mated with (e.g., plugged into) the housing 34 and a pilot structure receptacle 130 in the housing 34. The pilot structure receptacle 130 of FIG. 3 projects longitudinally through the housing sidewall 50 from the housing exterior 52 to the housing cavity 42. The entire first component 78 may be disposed within the pilot structure receptacle 130. The first base 88 projects longitudinally within the pilot structure receptacle 130 to the housing cavity 42/the respective combustion volume 66. The first mount 90 is seated longitudinally against a (e.g., annular) shoulder 132 of the housing 34 within the pilot structure receptacle 130. A first seal element 134 (e.g., a ring seal element) may be disposed longitudinally between and engage (e.g., contact) the first mount 90 and the housing 34.

The entire second component 80 may also be disposed within the pilot structure receptacle 130. The second component 80 is mated with (e.g., plugged into) the first component 78 and its second component receptacle 94. The second base 116, for example, projects longitudinally through the second component receptacle 94 to the chamber cavity 92. The second mount 118 is seated longitudinally against the first mount 90 within the pilot structure receptacle 130. A second seal element 136 (e.g., a ring seal element) may be disposed longitudinally between and engage (e.g., contact) the first mount 90 and the second mount 118. The second component 80 and its second mount 118 may be mechanically fastened to the housing 34 using one or more fasteners 138; e.g., bolts. Each bolt 138, for example, may extend sequentially through a respective one of the second fastener apertures 126 (see FIG. 7), a respective one of the first fastener apertures 108 (see FIG. 5) and into a respective threaded fastener aperture in the housing 34. The first component 78 and its first mount 90 may thereby also be secured to the housing 34; e.g., clamped or otherwise retained longitudinally between the second component 80 and its second mount 118 and the housing 34.

With the above pilot structure arrangement, the pilot chamber 74 is formed by and longitudinally between the first component 78 and the second component 80 within the pilot structure 68. In particular, the chamber cavity 92 forms a first portion of the pilot chamber 74 and the chamber recess 120 forms a second portion of the pilot chamber 74. However, while both the first component 78 and the second component 80 collectively form the pilot chamber 74, the first component 78 and its chamber cavity 92 may be configured to form a majority (more than fifty percent) of a volume of the pilot chamber 74; e.g., more than sixty percent (60%), seventy percent (70%) or even eighty percent (80%) of the pilot chamber 74. Note, the greater the percentage of the pilot chamber 74 formed by the first component 78, the greater percentage of the pilot chamber 74 formed by the ceramic material where, for example, the second component 80 is formed from metal.

The pilot chamber 74 of FIG. 3 is configured with a spherical geometry. The cavity surface 110 and/or the recess surface 128, for example, may each be configured as a partial spherical surface. The present disclosure, however, is not limited to such an exemplary pilot chamber geometry. The pilot chamber 74, for example, may alternatively be configured with a cylindrical geometry, a frustoconical geometry, etc.; however, the spherical geometry may facilitate a compact and durable pilot structure.

The pilot injector 70 of FIG. 3 is attached to the housing 34. This pilot injector 70 is configured to direct the pilot fuel into the pilot chamber 74 through the fuel aperture 104 in the pilot structure 68 and its first component 78. The pilot ignitor 72 of FIG. 3 is attached to the housing 34. This pilot injector 70 is received in (e.g., projects into or through) the ignitor aperture 106 in the pilot structure 68 and its first component 78. The pilot ignitor 72 may thereby extend to or into the pilot chamber 74 for igniting the pilot fuel within the pilot chamber 74.

To shield the pilot structure 68 from an environment and/or other components outside of the engine 26 and its housing 34, a cover 140 (e.g., a cover plate) is secured to the housing 34. The cover 140 covers (e.g., blocks, overlaps, etc.) an opening to the pilot structure receptacle 130 into the housing 34. The cover 140 may thereby enclose the pilot structure 68 and its components (e.g., 78 and 80) within the housing 34 and its pilot structure receptacle 130. The cover 140 of FIG. 3, in particular, is mechanically fastened to the housing 34 with one or more fasteners 142; e.g., bolts.

The pilot structure 68 of FIG. 3 is configured to be installed with and/or removed from the engine 26 and its housing 34 (e.g., completely) from an exterior of the engine 26 and its housing 34. Thus, assembly and/or maintenance personnel may not need access to an interior of the engine 26 and its housing 34 for pilot structure installation, inspection and/or removal. Removing the pilot structure 68 may also facilitate inspection of one or more elements internal to the engine 26; e.g., the rotor seal 62 of FIG. 2, the interior 64 of the housing sidewall 50 of FIG. 2, the rotor faces 58 of FIG. 2, etc. This may simplify engine assembly, inspection and/or maintenance.

Figure 8:
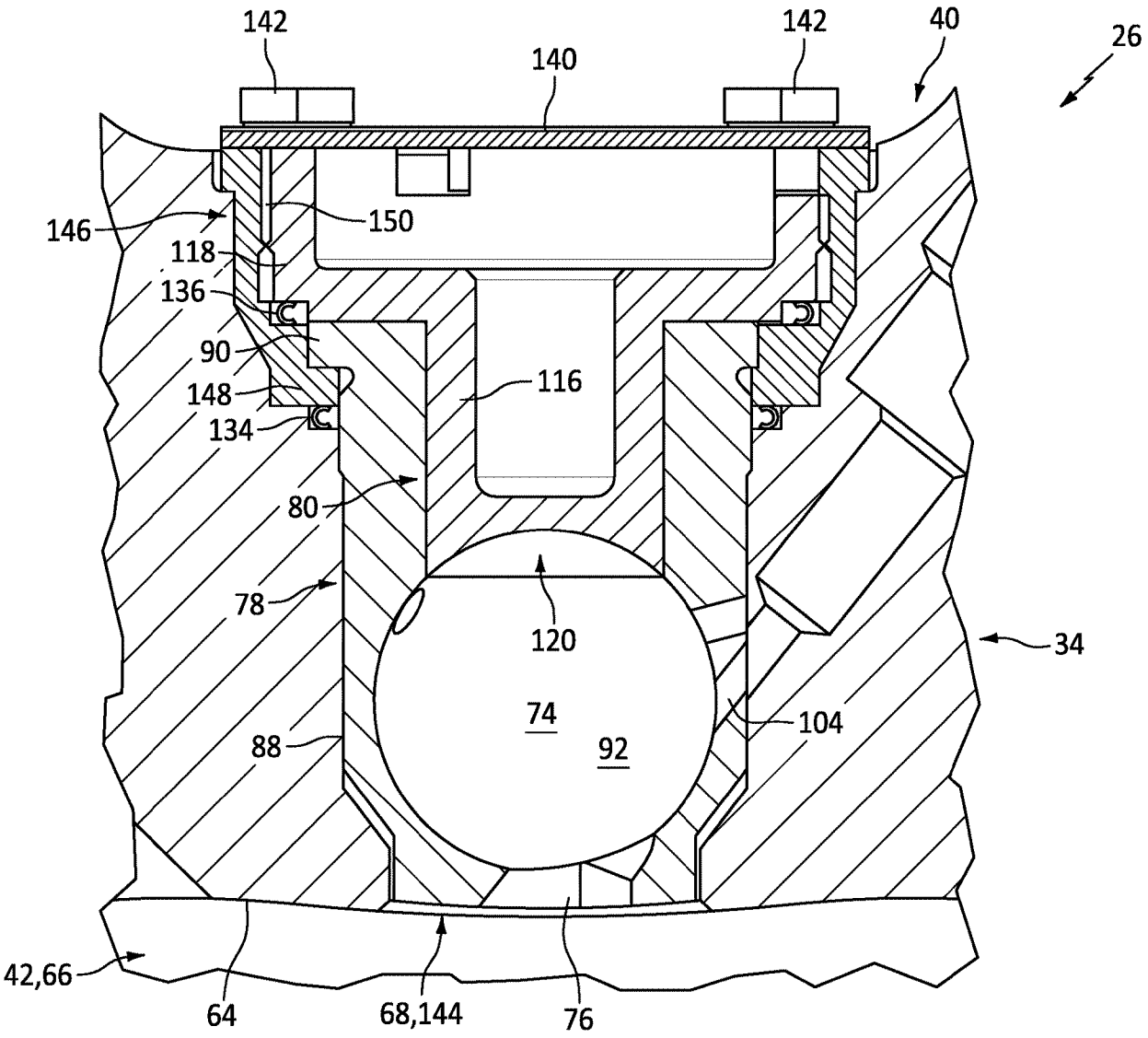
FIG. 8 is a sectional illustration of a portion of the engine with another ignition system.

In some embodiments, referring to FIG. 3, the first component 78 and the second component 80 may configured for individual installation with and/or removal from the engine 26 and its housing 34. In other embodiments, referring to FIG. 8, the first component 78 and the second component 80 may be installed with and/or removed from the engine 26 and its housing 34 as a unit. In particular, the pilot structure 68 of FIG. 8 is configured as or otherwise includes a pilot chamber module 144. This pilot chamber module 144 includes the first component 78, the second component 80 and a support ring 146 (e.g., a retainer). The first component 78 and the second component 80 may each have a similar configuration as generally described above with reference to FIGS. 3-7. However, rather than retaining (e.g., clamping) the first component 78 between the second component 80 and the housing 34 as shown in FIG. 3, the first component 78 of FIG. 8 and its first mount 90 are retained longitudinally between the second component 80 and its second mount 118 and the support ring 146. In particular, the first mount 90 is longitudinally clamped between an inner rim 148 of the support ring 146 and the second mount 118. The second component 80 and its second mount 118 may be mechanically attached to the support ring 146 through a threaded interface 150 between the second component 80 and the support ring 146. The second component 80 and its second mount 118, for example, may be threaded into a threaded aperture of the support ring 146. This assembled pilot chamber module 144 may then be installed with the housing 34 as a single unit. The pilot chamber module 144 and its support ring 146, for example, may be clamped or otherwise retained longitudinally between the cover 140 and the housing 34, where the cover 140 may be mechanically fastened to the housing 34 by the fastener(s) 142.

To seal the pilot structure 68, the first seal element 134 of FIG. 8 may be disposed longitudinally between and engage the support ring 146 and the housing 34, laterally adjacent the first component 78. The second seal element 136 of FIG. 8 may be disposed longitudinally between and engage the second component 80 and its second mount 118 and the support ring 146.

In the embodiment of FIG. 8, both the second component 80 and the support ring 146 may be formed from the metal to facilitate the threaded interface 150 therebetween. It is contemplated, however, the second component 80 may be otherwise secured to the support ring 146. In such embodiments, it is also contemplated the second component 80 and/or the support ring 146 may be formed from the ceramic material.

While the first component 78 is described above as being formed from ceramic, the present disclosure is not limited to such an exemplary construction. It is contemplated, for example, the first component 78 may alternatively be formed from metal (or another high temperature material) where, for example, the cavity surface 110 is coated with a thermal barrier layer.

The ignition system 40 is described above with reference to the rotary engine; e.g., the Wankel engine. It is contemplated, however, the ignition system 40 may alternatively be configured with various other types of engines such as a reciprocating piston engine or a gas turbine engine. The present disclosure therefore is not limited to any particular engine types or configurations.

While various embodiments of the present disclosure have been described, it will be apparent to those of ordinary skill in the art that many more embodiments and implementations are possible within the scope of the disclosure. For example, the present disclosure as described herein includes several aspects and embodiments that include particular features. Although these features may be described individually, it is within the scope of the present disclosure that some or all of these features may be combined with any one of the aspects and remain within the scope of the disclosure. Accordingly, the present disclosure is not to be restricted except in light of the attached claims and their equivalents.

What is claimed is:

1. An assembly for a powerplant, comprising:

a housing forming a combustion volume within the housing;

a primary fuel injector configured to inject primary fuel into the combustion volume; and an ignition system configured to ignite the primary fuel within the combustion volume, the ignition system including a pilot fuel injector, a pilot ignitor, a pilot chamber, a first component and a second component;

the pilot fuel injector configured to inject pilot fuel into the pilot chamber;

the pilot ignitor configured to ignite the pilot fuel within the pilot chamber;

the pilot chamber fluidly coupled with the combustion volume through an aperture in the first component, and the pilot chamber formed by and disposed between the first component and the second component;

the first component comprising a ceramic; and the second component fastened to the housing by one or more fasteners, and the first component clamped between the second component and the housing.

2. The assembly of claim 1, wherein the second component comprises a metal.

3. The assembly of claim 1, wherein the pilot chamber has a spherical geometry.

4. The assembly of claim 1, wherein a majority of a volume of the pilot chamber is formed within the first component.

5. The assembly of claim 1, wherein the first component extends longitudinally along a centerline towards the combustion volume; and a portion of the pilot chamber extends laterally into and longitudinally within a sidewall of the first component.

6. The assembly of claim 1, wherein the first component includes a cavity and a receptacle;

the cavity forms at least a portion of the pilot chamber within the first component;

the receptacle extends longitudinally into the first component to the cavity; and the second component projects longitudinally into the receptacle to the pilot chamber.

7. The assembly of claim 6, wherein the second component includes a recess at a distal end of the second component; and the recess forms a portion of the pilot chamber within the second component.

8. The assembly of claim 6, wherein the cavity has a lateral cavity width; and the receptacle has a lateral receptacle width at a longitudinal interface between the receptacle and the cavity, and the lateral receptacle width is smaller than the lateral cavity width.

9. The assembly of claim 6, wherein a second receptacle extends longitudinally into the housing from an exterior of the housing to the combustion volume; and the first component is disposed within the second receptacle and projects longitudinally to the combustion volume.

10. The assembly of claim 9, further comprising a cover secured to the housing and enclosing the first component and the second component within the second receptacle.

11. The assembly of claim 1, further comprising at least one of a first seal element engaged with and between the first component and the housing; or a second seal element engaged with and between the first component and the second component.

12. The assembly of claim 1, wherein at least one of the pilot fuel injector is configured to inject the pilot fuel into the pilot chamber through a fuel aperture in the first component; or the pilot ignitor is received in an ignitor aperture in the first component.

13. The assembly of claim 1, further comprising a rotary engine that includes the housing, the primary fuel injector and the ignition system.

14. An assembly for a powerplant, comprising:

a housing forming a combustion volume within the housing;

a first component including a cavity, a receptacle and an aperture, the cavity forming at least a portion of a chamber within the first component, the receptacle extending longitudinally into the first component to the cavity, the aperture fluidly coupling the chamber to the combustion volume, and the first component comprising a ceramic;

a second component projecting longitudinally into the receptacle to the chamber;

a fuel injector configured to inject fuel into the chamber; and an ignitor configured to ignite the fuel within the chamber.

15. An assembly for a powerplant, comprising:

a housing forming a combustion volume within the housing;

a chamber module fastened to the housing, the chamber module including a first component, a second component, a support ring and a chamber, the first component clamped between the second component and the support ring, the first component projecting through a receptacle in the housing to the combustion volume, the second component secured to the support ring through a threaded interface between the second component and the support ring, the chamber formed by and between the first component and the second component, and the chamber fluidly coupled to the combustion volume through an aperture in the first component;

a fuel injector configured to inject fuel into the chamber; and an ignitor configured to ignite the fuel within the chamber.

16. The assembly of claim 15, further comprising a first seal element engaged with and between the support ring and the housing.

17. The assembly of claim 15, further comprising a second seal element engaged with and between the second component and the support ring.

18. The assembly of claim 15, further comprising:

a cover over the chamber module;

the cover fastened to the housing by one or more fasteners; and the pilot chamber module clamped between the cover and the housing.

* * * * *